United States Patent [19]

Olanders

[11] Patent Number: 5,011,664

[45] Date of Patent: Apr. 30, 1991

[54] ARRANGEMENT FOR THE STERIILIZATION OF A TRAVELLING MATERIAL WEB

[75] Inventor: Pär Olanders, Lund, Sweden

[73] Assignee: Roby Teknik AB, Lund, Sweden

[21] Appl. No.: 250,269

[22] Filed: Sep. 28, 1988

[30] Foreign Application Priority Data

Oct. 9, 1987 [SE] Sweden ..... 8703903

[51] Int. Cl.[5] ..... A61L 2/20

[52] U.S. Cl. ..... 422/292; 422/302; 422/304; 53/167; 53/425

[58] Field of Search ..... 422/292, 302, 297, 300, 422/304, 307, 26, 27, 28; 53/167, 425, 426; 34/152, 155, 156, 160, 162

[56] References Cited

U.S. PATENT DOCUMENTS

| | | | |
|---|---|---|---|
| 4,014,158 | 3/1977 | Rausing | 53/167 |
| 4,104,024 | 8/1978 | Vogele et al. | 53/167 |
| 4,274,210 | 6/1981 | Stengard | 34/156 |
| 4,603,490 | 8/1986 | Hilmersson et al. | 34/155 |
| 4,707,334 | 11/1987 | Gerhard | 422/28 |

FOREIGN PATENT DOCUMENTS

| | | | |
|---|---|---|---|
| 2703524 | 8/1978 | Fed. Rep. of Germany . | |
| 3031684 | 4/1982 | Fed. Rep. of Germany | 53/425 |
| 304082 | 9/1968 | Sweden . | |

OTHER PUBLICATIONS

Abstract of Dialog Search (Patents Index) WPI Acc. No. 78-56977A/32 (Aug. 3, 1978).

*Primary Examiner*—David L. Lacey
*Assistant Examiner*—William H. Beisner
*Attorney, Agent, or Firm*—Burns, Doane, Swecker & Mathis

[57] ABSTRACT

An arrangement for sterilizing a travelling material web comprises a chamber having an inlet and an outlet so that the material web can enter and exit the chamber. Constriction zones are arranged between the inlet and outlet and are connected to one another by an intermediate chamber portion. The constriction zones are designed so that the web material is just able to pass freely between the constriction zones. The intermediate chamber portion is connected to a gas source while each of the constriction zones are connected to a vacuum source.

8 Claims, 2 Drawing Sheets

ARRANGEMENT FOR THE STERIILIZATION OF A TRAVELLING MATERIAL WEB

FIELD OF THE INVENTION

The present invention relates to an arrangement for the sterilization of a travelling material web, to an arrangement for the sterilization of a traveling web that afterwards is to be converted to so-called aseptic packages.

BACKGROUND OF THE INVENTION

Consumer packages of a non-returnable character are manufactured at present with the help of modern, high-capacity machines of the type which from a web or from prefabricated blanks of a packing material form, fill and close the packages. The machines manufacture packages from a web by first converting the web to a tube by durably joining together the longitudinal edge zones in a strong overlap joint. The tube formed is then filled with the intended contents and divided into individual, filled packing units through repeated transverse sealings of the tube across the longitudinal axis of the tube below the actual contents level, whereafter the packing units are separated from one another by means of transverse cuts in the transverse sealings made, and, possibly after a final shaping, discharged from the machine as finished packages.

A very large group of these so-called non-returnable packages is manufactured from a material comprising a carrier layer of paper or cardboard and outer and inner coatings of plastics, in particular thermoplastics, which beside making the packages liquid-tight also may be used for performing the aforementioned sealings through so-called heat-sealing during the manufacture of the packages.

With the help of packing machines of the above-described type, it is also known to make so-called aseptic packages for certain types of sensitive, liquid foodstuffs, e.g. milk, in order to prolong the keeping properties of the contents. The aseptic machines operate in principle in the same manner as the machines described earlier, but with the important difference that the manufacture of the packages is carried out under aseptic conditions which means that the contents as well as the packing material have to be sterile, and likewise, the atmosphere in the machine where the tubes are formed and filled must be sterile. The sterile atmosphere in the machine is obtained by maintaining a certain pressure of sterile gas, usually superheated sterile air, inside the tubes as well as in the close environment of the tubes. As a result, leakage of polluted, non-sterile air from the outer environment of the machine is prevented. The sterile contents usually are obtained by subjecting the contents prior to filling to a heat treatment whereby the contents for a certain period are heated to, and held at, a sufficiently high temperature in order to eliminate harmful micro-organisms. It has not been too difficult to fulfil these two sterility requirements, but it has been found more difficult, with the methods available up to now, to provide a simple, effective sterilization of the weblike packing material.

The sterilization of the packing material web is carried out by passing the web prior to conversion to tubular shape through a bath of chemical sterilizing agent, usually a 10–35% hydrogen peroxide solution which is made to moisten the packing material, whereupon the surplus of liquid is removed from the web by means of calender cylinders. Any sterilizing agent remaining on the web is removed, after conversion of the web to a tube, by a heating arrangement which heats the material tube to such a degree that the agent is evaporated and driven off through the upper, open end of the tube.

In accordance with another known method, the packing material web is passed through a chamber containing heated, gaseous sterilizing agent, preferably a mixture of hydrogen peroxide and steam, to absorb hydrogen peroxide through condensation on the material web. In this known method too the remaining sterilizing agent is removed by evaporation.

Even though the known methods described here, which use liquid sterilizing agent either directly or indirectly through condensation, function well for material webs with plain, uniform surfaces, it has proved more difficult to achieve an effective sterilization of packing material webs with surface irregularities, e.g. tear strips (so-called pull-tabs) sealed over prepared emptying openings. This is due, at least partly, to the material web being in contact with the sterilizing agent during a time which is too short to allow the sterilizing agent to penetrate, and act in, the less readily accessible spaces of such irregularities. Another problem, which is also connected with using the sterilizing agent in liquid form, and which becomes particularly manifest when the web is passed through a bath, is the difficulty of preventing so-called edge absorption of the sterilizing agent in web portions with freely exposed fibre layers, e.g. in the area along longitudinal cutting edges of the web which easily absorb moisture.

It is known that a mixture of hydrogen peroxide and water in gas form has a sterilizing effect which increases with rising temperature, and it is known, moreover, that gas, by contrast to liquid, can easily penetrate into less readily accessible areas of the type which occur on material webs with surface irregularities, and a natural and obvious solution of the problems which are inherent in the known methods described should be, therefore, to substitute the sterilizing agent in liquid form by a corresponding sterilizing agent in gas form and carry out the sterilization exclusively in the gas phase, that is to say without condensation.

Notwithstanding the realization that an effective sterilization can be carried out with the help of a gaseous sterilizing agent, e.g. water/hydrogen peroxide-vapour, regardless of the surface quality of the material web, it has been difficult up to now to utilize that method.

OBJECTS AND SUMMARY OF THE INVENTION

It is the object of the present invention, therefore, to provide an arrangement by means of which such a gas phase sterilization of a travelling material web is practically possible.

This object is achieved in accordance with the present invention in that an arrangement of the type described in the introduction is provided with a chamber that has constriction zones arranged between the inlet and the outlet which are connected to one another through an intermediate chamber portion and are designed so that the web is just able to pass freely between the constriction zones. The intermediate chamber portion is connected to a source for the sterilizing gas by means of at least one inlet opening provided in the chamber portion, and the constriction zones are connected to an external vacuum source through one or more outlet openings for the gas arranged adjoining the constriction zones.

Owing to the zones of the chamber being designed as constrictions between the inlet and outlet of the material web the gas entering through the inlet opening or openings in the intermediate chamber portion is forced to flow at very high speed in close contact with the material web passing by within the areas of the said constriction zones, which ensures good contact and consequently effective sterilizing action uniformly distributed over the whole width of the material web.

The intermediate chamber portion serving as a distributing space for the incoming sterilizing gas preferably has a somewhat larger free transverse flow area than the constriction zones situated on either side of the chamber so as to facilitate and ensure an effective distribution of the sterilizing agent on both sides of the material web. However, in accordance with the invention the intermediate chamber portion may also be designed, with the same transverse flow area as the constriction zones and in fact constitute the intermediate part of a single unbroken constriction zone, the good distribution of the sterilizing gas aimed at being provided in this case with the help of oppositely directed inlet openings in the intermediate chamber part, preferably arranged on either saide of the material web.

In accordance with a simple embodiment of the invention the chamber is arranged in an elongated, rectangular box with an inlet and outlet located along a straight line at opposite ends of the box, as a result of which the material web can be conducted through the chamber without coming into contact with any parts of the chamber. The inlet opening or openings for the sterilization gas preferably are arranged here in a chamber portion situated centrally between the inlet and the outlet for the web. The constriction zones may be formed, for example, by elongated restricting elements or plates, situated oppositely in pairs and arranged between the intermediate chamber portion and the inlet and the outlet respectively, which between them form narrow, gaplike passages of a design which is such that the web is just able to pass freely between the plates. The plates or corresponding passage-limiting elements, which may be suspended or fixed to form a seal in some other appropriate manner on the inner walls of the box, are preferably arranged with their remote ends situated at some distance from the neighbouring end walls of the box so as to form end chamber portions located at the inlet and outlet respectively with a larger free flow passage than the constriction zones or passages formed between the plates, the outlet openings for the sterilizing gas being arranged in direct connection to these end portions. As a result of such a location of the outlet openings a virtually complete evacuation from the constriction zones is facilitated and assured.

When the arrangement in accordance with the invention is to be used for the sterilization of a material web intended for the manufacture of aseptic packing containers, the sterilizing gas as well as the material web have to be heated and maintained at a temperature above the dew point of the sterilizing gas so as to avoid any condensation of the gas on the material web. To assure such condensation-free sterilization the arrangement in accordance with the invention may comprise a heating arrangement placed before and/or immediately adjoining the chamber through which, or past which, the material web is conducted for heating before entry into the chamber. Preferably the chamber is also provided with a suitable heating arrangement, e.g. electric heating elements and/or a source of radiation e.g. UV-light, which also provides the possibility of an improved sterilizing effect through synergism, arranged around or within the walls of the chamber, so as to heat the chamber walls to a sufficient extent in order to eliminate the risk of condensation occurring on the inner walls of the chamber As mentioned earlier the outlet openings for the sterilizing gas are connected to an external vacuum source with the help of which the rapid gas flow through the chamber is achieved. The vacuum source may comprise, for example, a so-called water ring compressor or some other suitable pressure-reducing system by means of which the sterilizing gas can be purified before reutilization.

BRIEF DESCRIPTION OF THE DRAWINGS

The invention will be described in greater detail with special reference to the attached drawing, wherein.

DETAILED DESCRIPTION

Figure 1:
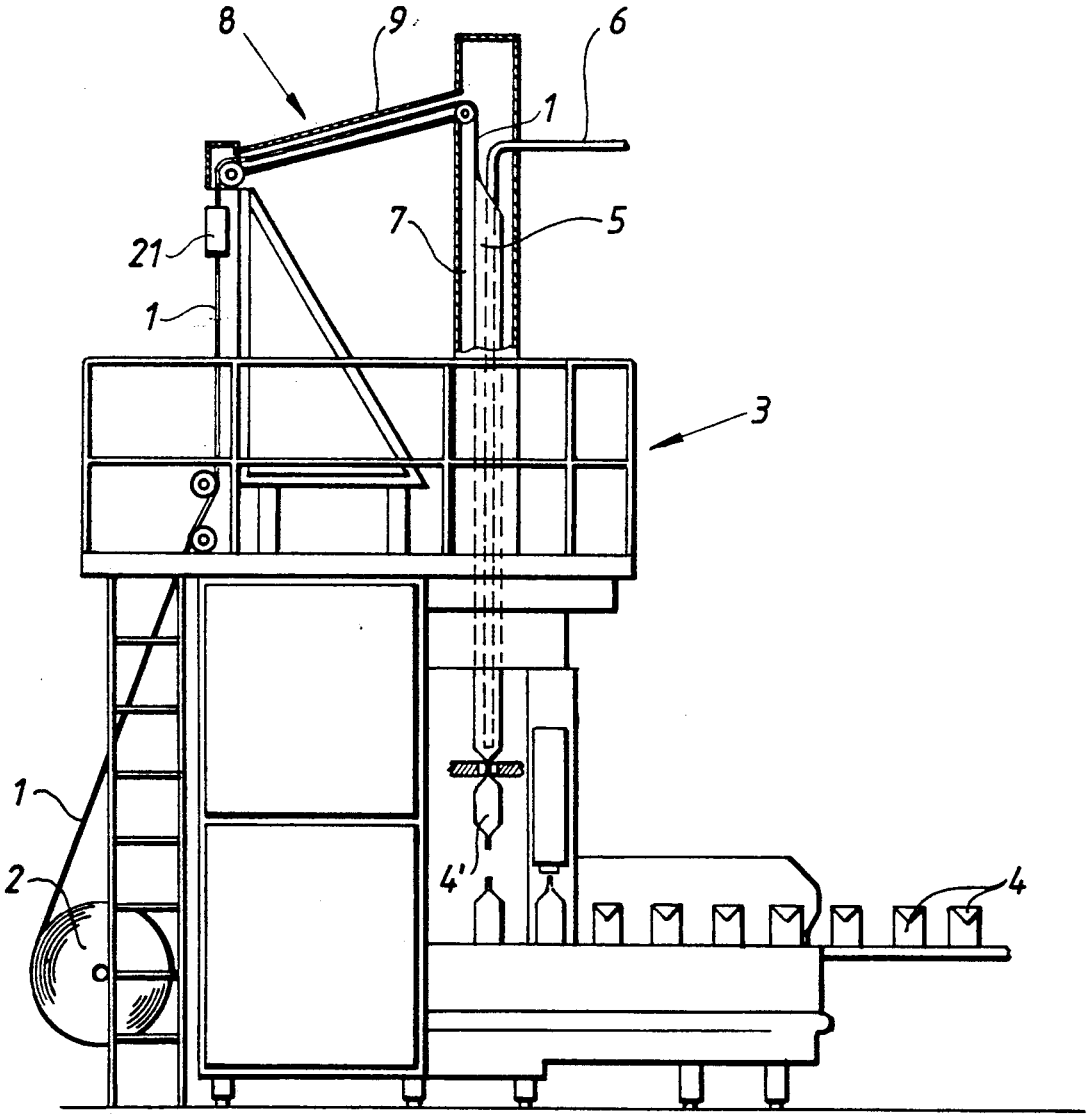
FIG. 1 is a side showing how an arrangement in accordance with the invention can be installed and used in a conventional packing machine of the type which manufactures aseptic packing containers from a web of packing material and FIG. 2 is an enlarged side view of a portion of the arrangement illustrated in FIG. 1.
Figure 2:
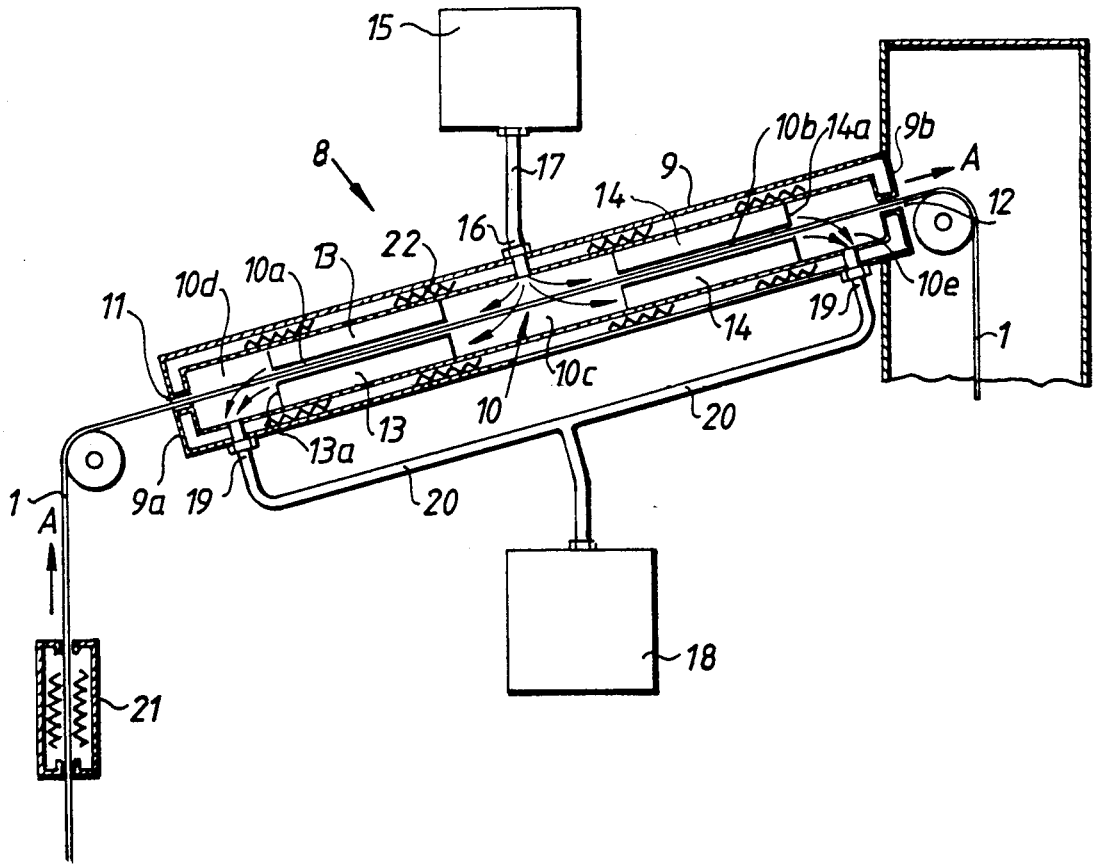

From a material web 1, which is supplied from a magazine roll 2, the packing machine shown (with the general designation 3) manufactures finished, filled packages 4 in that the web 1 first is converted to a tube 5 by durably joining together the longitudinal edges of the web in a longitudinal overlap joint. The tube 5 is filled with the intended contents through a filling pipe 6 introduced through the upper open end of the tube and is divided into individual packing units 4' through repeated transverse sealings across the longitudinal axis of the tube below the actual contents level in the tube, whereafter the packing units 4' are separated from one another by means of cuts in the transverse sealings. The packing units 4' are then conducted through a final shaping station in the machine and discharged thereafter as finished packages 4 at the discharge end of the machine.

It is a prerequisite, if the packages are to be aseptic, that the contents to be packed and the material web 1 must be sterile, and that the whole filling process including the conversion of the web to a tube in the filling zone 7 of the machine is carried out in a sterile environment. The sterility of the contents is achieved by subjecting the contents prior to filling to a heat treatment according to a previously specified temperature/time scheme, and the sterile environmental atmosphere in the filling zone 7 is provided by maintaining a certain pressure of hot sterile air within this zone, as a result of which leakage of polluted, non-sterile air from the environment of the machine is prevented. The sterility of the material web 1 which is fed into the filling zone 7 of the machine through a sealed inlet at the upper end of the zone is provided with the help of the arrangement in accordance with the invention (generally designated 8) shown at the top of the machine.

The arrangement 8 in accordance with the invention has an elongated, rectangular box 9 arranged at the top of the packing machine 3 comprising a chamber 10 with an inlet 11 and outlet 12 for the material web 1 that are located along a straight line at opposite ends 9*a* and 9*b* respectively of the box 9. The box 9 which may be made, for example, from stainless steel has plate elements 13 and 14 respectively situated in oppositely positioned pairs which are fixed so as to form a seal to the inner walls of the chamber 10. The pairs of plate elements 13 and 14 form gaplike passages or constriction zones 10*a* and 10*b* respectively that are situated along a straight line. The constriction zones 10*a* and 10*b* are dimensioned so that the material web 1 is just able to pass freely between the constriction zones, and are connected to one another by a chamber portion 10*c* located between the constriction zones. The ends 13*a* and 14*a* of the plates 13 and 14 facing away from one another are arranged to terminate at a short distance from the end walls 9*a* and 9*b* respectively of the box so as to form inner chamber portions 10*d* and 10*e* respectively situated at corresponding ends of the box 9. As is evident, the constriction zones 10*a* and 10*b* have a much smaller free transverse flow area than the end portions 10*d* and 10*e* and the intermediate portion 10*c* of the chamber 10.

The intermediate chamber portion 10*c* is connected to an external source 15 of sterilizing gas through an inlet opening 16 arranged in the chamber portion 10*c* and a duct 17 connected thereto, whilst the end portions 10*d* and 10*e* of the chamber are in connection with an external vacuum source 18 through outlet openings 19 arranged in respective end portions and ducts 20 connected to them.

The vacuum source 18 consists preferably of a so-called water-ring compressor or a corresponding pressure-reducing means which makes possible a regeneration of the sterilizing gas flowing out through the outlet openings 19.

The arrangement 8 in accordance with the invention, moreover, has a heating arrangement 21 placed before the inlet 11 of the chamber 10, with the help of which the material web 1 travelling past, or through, the heating arrangement 21 prior to entry into the box 9 can be heated to a temperature above the dew point of the sterilization gas used so as to prevent condensation of the sterilization gas on the material web 1 when the same passes through the box 9. Electrically heated heating elements 22 are provided in or around the walls of the box 9 for heating the inner walls of the chamber, to thereby avoid the formation of condensation on the same.

The arrangement 8 functions in the following manner: When the material web 1, preheated with the help of the heating arrangement 21, which is to be sterilized by means of the arrangement 8, is fed in the direction of the arrow A via a deflection roller into and through the chamber 10 it is brought into intimate contact with the sterilizing gas flowing in through the inlet opening 16 in the intermediate chamber portion 10*c* which in the intermediate chamber portion 10*c*, the sterilizing gas distributes itself well on both sides of the material web and which has the vacuum source 18 connected to the outlet openings 19 cause the sterilizing gas to flow at a very high flow velocity in close contact with the two sides of the material web in the constriction zones 10*a* and 10*b* formed between the plates 13 and 14 respectively, as a result of which good contact is achieved within these constricted chamber portions between the sterilizing gas and the material web passing by along the whole width of the web. After passage through the constriction zones 10*a* and 10*b* the sterilizing gas is evacuated from the chamber 10 through the outlet openings 19 and the ducts 20 for possible regeneration and reutilization. The sterilized material web 1 is conducted out through the outlet opening 12 of the chamber and further into, and through, the sterile filling zone 7 of the packing machine 3 shown in FIG. 1 for conversion to aseptic packages 4.

The arrangement in accordance with the invention described above can be used in principle for the sterilization of any conceivable travelling material web, but has been found to function especially well in the sterilization of laminated packing material of the type mentioned earlier for conversion to aseptic packing containers. With the help of the arrangement in accordance with the invention it has thius proved to be possible, in a simple manner, to achieve an effective sterilization of a packing material web, irrespectively of the surface structure of the material web. While this invention has been illustrated and described in accordance with a preferred embodiment, it is recognized that variations and changes may be made and equivalents employed herein without departing from the invention as set forth in the claims.

I claim:

1. Apparatus for gas-phase sterilizing a travelling material web comprising:

an elongated chamber having an inlet at one end and an outlet at the opposite end, said inlet and outlet being aligned to allow a material web to extend along a predetermined path into the chamber through the inlet and out of the chamber through the outlet, said chamber having interior walls spaced apart on opposite sides of said path, first conduit means for introducing a sterilizing gas into said chamber and second conduit means for withdrawing gas from said chamber, said first and second conduit means being spaced apart longitudinally of said chamber, said chamber including constriction means for accelerating the sterilizing gas along the path and for forcing the sterilizing gas to flow in close contact with the material web at very high speed as the gas flows from the first conduit means to the second conduit means to ensure that the sterilizing gas contacts and is uniformly distributed over the whole width of the material web so that effective sterilization of the entire material web takes place, said constriction means including a pair of plates extending outwardly from said interior walls toward said path, said plates being positioned between said first and second conduit means, and a heating device positioned in front of the inlet to the chamber so that the material web will be subjected to heat from the heating device prior to entering the chamber.

2. The apparatus in accordance with claim 1, wherein said second conduit means includes outlet conduits adjacent opposite ends of said chamber.

3. The apparatus in accordance with claim 2, wherein said first conduit means is positioned midway between said opposite ends of said chamber, said first-mentioned pair of plates being between said outlet conduit adjacent said inlet opening end of said chamber and including a second pair of plates in said chamber between said first conduit means and said outlet opening end of said chamber.

4. The apparatus in accordance with claim 1, and further comprising means positioned within the chamber for interiorly heating the chamber.

5. The apparatus in accordance with claim 4, wherein said means for interiorly heating the chamber includes electric heating elements.

6. Apparatus for sterilizing a moving material web comprising;

an elongated chamber having a web inlet and a web outlet defining a web path through the chamber, a gas inlet for introducing sterilizing gas into said chamber and a gas outlet for withdrawing sterilizing gas from said chamber, said chamber having interior walls spaced apart on opposite sides of said path, a pair of spaced apart plate elements in said chamber mounted on said interior walls on opposite sides of said path, said plate elements each having a substantially flat surface adjacent said web path and having opposite ends extending across said chamber to direct gas flow into the space between said plate element surfaces, said plate elements ends being spaced from said gas inlet and said gas outlet, whereby the gas flow area between said plate element surfaces is smaller than the gas flow area adjacent said gas inlet and said gas outlet to cause accelerated gas flow between said plate element surfaces, and a heating device positioned in front of the inlet to the chamber so that the material web will be subjected to heat from the heating device prior to entering the chamber.

7. The apparatus according to claim 6, wherein said gas inlet is positioned midway of the distance between said web inlet and said web outlet, and said gas outlet is positioned adjacent said web inlet, and including an additional gas outlet positioned adjacent said web outlet.

8. The apparatus according to claim 7, wherein said chamber includes a second pair of spaced apart plate elements positioned between said gas inlet and said additional gas outlet.

* * * * *